US009168450B1

(12) United States Patent
Stanford

(10) Patent No.: US 9,168,450 B1
(45) Date of Patent: Oct. 27, 2015

(54) MINIATURE BOWLING GAME

(71) Applicant: Calvin James Stanford, Jacksonville, FL (US)

(72) Inventor: Calvin James Stanford, Jacksonville, FL (US)

( * ) Notice: Subject to any disclaimer, the term of this patent is extended or adjusted under 35 U.S.C. 154(b) by 0 days.

(21) Appl. No.: 14/617,967

(22) Filed: Feb. 10, 2015

(51) Int. Cl.
*A63D 3/00* (2006.01)
*A63D 3/02* (2006.01)
*A47B 25/00* (2006.01)

(52) U.S. Cl.
CPC .. *A63D 3/02* (2013.01); *A47B 25/00* (2013.01)

(58) Field of Classification Search
CPC ..... A63D 3/02; A47B 25/00
USPC ..... 473/10, 14, 115, 116; 273/129 Q
See application file for complete search history.

(56) References Cited

U.S. PATENT DOCUMENTS 418,737 A * 1/1890 Meindi ..... 473/107
1,144,529 A * 6/1915 Crampton ..... 473/107
1,172,570 A * 2/1916 Toelle ..... 124/7
1,252,534 A * 1/1918 Bauch ..... 473/107
1,268,741 A * 6/1918 McCoy ..... 473/107
1,681,590 A * 8/1928 Marczinko ..... 473/107
2,000,123 A * 5/1935 Cahill ..... 473/5
2,490,288 A * 12/1949 Wickersham ..... 473/107
3,215,436 A * 11/1965 Carter ..... 473/171
3,756,598 A * 9/1973 Maeda ..... 473/107
5,096,192 A * 3/1992 Stanford, Jr. ..... 473/109
5,183,261 A * 2/1993 Nobi ..... 473/109
5,374,220 A * 12/1994 Burtchett ..... 473/116
5,655,768 A * 8/1997 Moret et al. ..... 273/108.5
6,039,655 A * 3/2000 Todokoro ..... 473/116
2010/0267459 A1* 10/2010 Adams ..... 473/116
2011/0312432 A1* 12/2011 Fu ..... 473/116

OTHER PUBLICATIONS

REMCO Spunky Bowling Shuffleboard Skeebal Play Set for Doll 1960's Nice!, http://www.ebay.com/itm/REMCO-SPUNKY-BOWLING-SHU FFLEBOARD-SKEEBAL-PLAY-SET-FOR-DOLL-1960S-NICE-/251553766789?pt=LH_Default Domain_0 &hash=item3a91 c5dd85#ht_150wt1362, 1960.*

* cited by examiner

*Primary Examiner* — William Pierce
(74) *Attorney, Agent, or Firm* — Lawrence J. Gibney, Jr.

(57) ABSTRACT

A bowling game table featuring a lane surface having a bilaterally symmetrical trough on each side of the flat top surface. A ramp that swivels from side to side from which a ball is rolled will allow a person to "aim" a ball as he or she tries to strike a set of pins on the opposite end of the bowling game surface. In order to level the playing field among the players a handicap pin system has been provided. In order to improve the function of the game surface the top surface is reversible to display other games that may be played.

5 Claims, 3 Drawing Sheets

MINIATURE BOWLING GAME

REFERENCE TO OTHER APPLICATIONS

A provisional application was filed on Jan. 2, 2013 with Ser. No. 61/748,238 and the applicant seeks priority based on that application. The applicant is filing a continuation in part from the non-provisional that was filed on Dec. 30, 2013 and seeks priority from the date of the provisional application.

BACKGROUND OF THE INVENTION

A. Field of the Invention

This invention involves a unique configuration for a miniature bowling alley and game. Thus, the invention touches, in general fashion, on the fields of both bowling and game tables. However, it can be more specifically and exactly classified as part of the field of miniature bowling games/tables.

B. Prior Art

Numerous patents, both design and utility, have been granted in the field of bowling type game tables. The applicant has been granted a prior patent related to this type of device: Stanford U.S. Pat. No. 5,096,192 that was issued on Mar. 17, 1992.

Substantial improvements have been made to the prior patent in this application. Some of the improvements include the addition of a handicap pin system, the use of Braille indicators, the installation of an automatic ball return, the incorporation of two sided surfaces with one side being slightly indented to simulate a "gutter" ball and the ability to play different games on the opposite side with the use of overlays.

BRIEF SUMMARY OF THE INVENTION

The instant invention seeks to duplicate, in most respects, the features and challenges offered by a full scale bowling alley in a miniature format. It is able to accomplish this object primarily due to the unique curvature given to the surface of the lane provided. However, it is assisted in accomplishing this goal by the inventor's provision of means for adjusting the tilt of incline of the alley, his provision of a simple and practical means for altering and controlling the angle and speed of the ball launched, and by his inclusion of other features that assist the players and add realism to the format.

In full scale bowling the bowling ball is launched toward a set of ten bowling pins at the opposite end of the lane. The lane surface in full scale bowling is straight and flat from the foul line to the pins. However, the bowler very seldom launches a bowling ball in a straight line toward the pins. First, it is almost impossible to launch a bowling ball without some degree of spin. Second, a straight, non-curving trajectory is not necessarily more advantageous to the bowler. Many of the shots practiced and much of the challenge of the game is based on the curve given to the ball's path as it moves toward the pins. As a rule, the right handed bowler will, without even trying, impart a counter-clockwise rotation to the ball, causing the ball to curve from right to left. Likewise, a left handed bowler normally imparts a clockwise rotation, creating a curve from left to right. All bowlers practice to control what begins as an unintended natural phenomenon, and learn to control the spin/curve of the ball with great accuracy. Thus, a vast number of trajectories or paths may be obtained by an experienced bowler.

In the instant invention, the same options are possible due to the nature of the lane surface. The lane surface is uniquely constructed utilizing various contours that range from flat, to slightly concave, to a more pronounced bowl-type contour before slowly rising to return to a flat triangular section where the pin deck is located. This curvature allows the player to select from a number of shots in approaching the pins, ranging from a straight ball down the center of the lane to a hard breaking curve ball from either right to left or left to right depending on the target. If a right to left curve is desired the ball is launched down the right side of the lane. The contour will then cause a right to left curve. The further to the right the ball is launched, the more that it will break back to the left. The same techniques may be used on the opposite side of the lane if a left to right curve is sought. The straight ball may be obtained by launching the ball directly down the center of the lane. This will send the ball down the bottom of the contour. A straight ball may also be used to shoot cross-lane in attempting a corner pin spare as in the sport of bowling.

The sport of bowling is made even more challenging by altering the conditions of the lane through application of oil on certain sections of the lane surface. The more oil is placed on the lane, the less friction is created between the ball and the lane surface. This causes the bowling ball to curve less. As the amount of oil decreases, friction increases and the tendency of the ball to curve is, likewise, greater.

Although there is never any oil used on the lane provided in the instant invention, similar effects may be created and conditions may be otherwise changed by use of adjustable foot pads on each leg. A player may become very proficient with the table and the angles necessary to use in playing the game. This can create an unfair advantage or monotony for the participants. By use of the adjustable footpads, it is a simple procedure to raise one side of the table over the other. This completely changes the game for all concerned. For example, if you raise the left side of the table, the ball will curve more from left to right, and less from right to left. You may also affect lane conditions by raising or lowering the ends of the table. By raising the end where the pins are located, a slight incline is created. As the ball is launched, this incline slows the ball slightly and allows the contours of the alley surface to more strongly affect the trajectory of the ball, causing greater curvature from both sides of the lane. If the other end of the table is raised, the ball's speed will be increased, causing less curve from either side. Thus, just as in the sport of bowling, the players may be given an almost unlimited variety of conditions, insuring variety and challenge for players of all ages and skills.

NUMBERING DESCRIPTION

Figure 1:
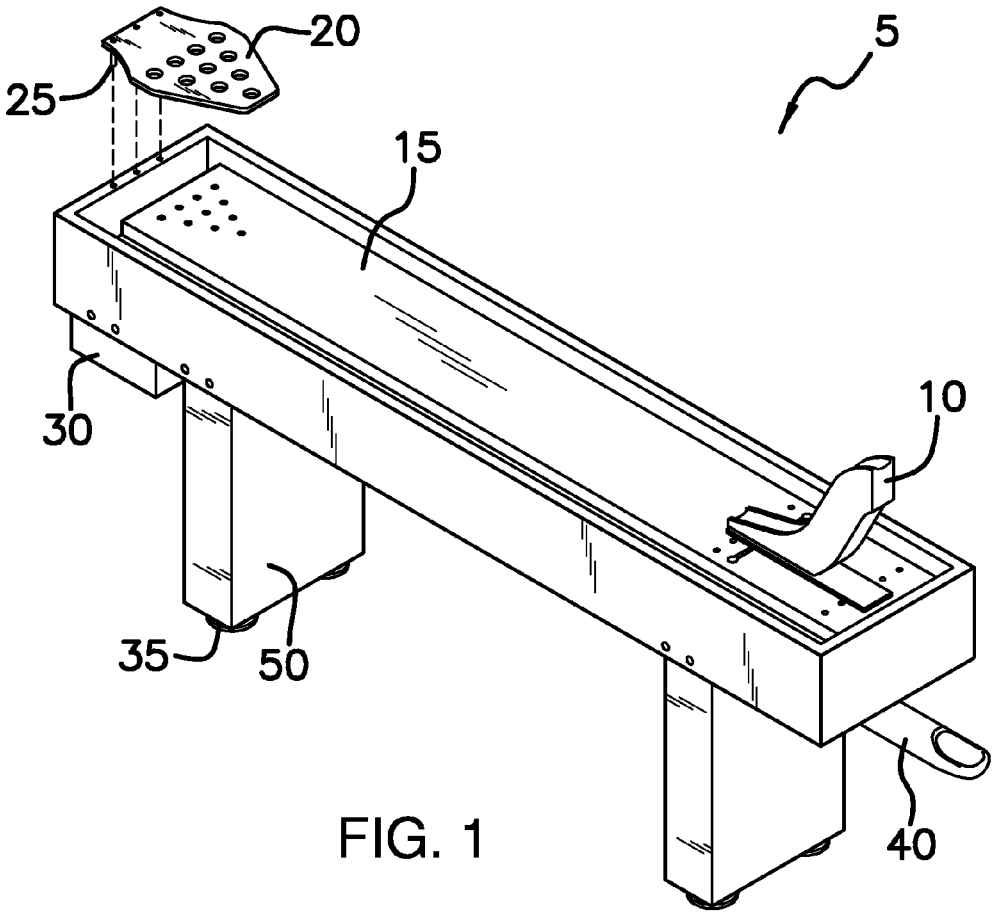
FIG. 1 is an isometric view of the device showing a bowling surface.

5 Device
10 Ramp

11 Handicap holes
12 Handicap pin
14 Ramp adjustment
15 Bowling surface
16 Indentation
17 Braille indicators
20 Auto spotter
25 Mounting parts for auto spotter
30 Pin box
32 Ball return
35 Adjustable feet
40 Automatic ball return tube
45 Shuffleboard surface
50 Legs
60 Game overlays

DETAILED DESCRIPTION OF THE EMBODIMENTS

This device 5 was originally intended for those who are physically challenged to be able to play bowling on a flat level surface. There is a flat planar rectangular playing surface that has two sides: one side depicts a bowling game 15 and the other depicts a shuffleboard surface 45. Additionally a set of game overlays 60 are placed over the shuffleboard surface 15 to allow an individual to play other types of games.

The device 5 will be mounted on legs 50 which have adjustable feet 35 to adjust the level or the angle of the top surface of the device, if desired.

There is a large flat rectangular playing surface with a first side for the bowling surface 15 and a second reverse side depicting a shuffleboard surface 45.

The top surface will consist of a bowling surface 15 on one side and a shuffleboard surface 45 on the opposite side. The bowling surface 15 has indentations 16 on the outer edges as depicted in FIG. 2 so that a "gutter" ball can be produced when the game of bowling is played.

In this manner the person can alternate between playing a bowling game and a shuffleboard game by simply turning over the playing surface. In order to insure that the surface remains stationary a means to clamp the surface in place will be provided. No particular means to clamp the top surface is being claimed in this application.

Additionally the bowling surface 15 will not cover the entire top area; an indentation of the sides of the top surface will be provided to simulate the "gutter" ball that is sometimes thrown on a regular bowling surface.

Figure 2:
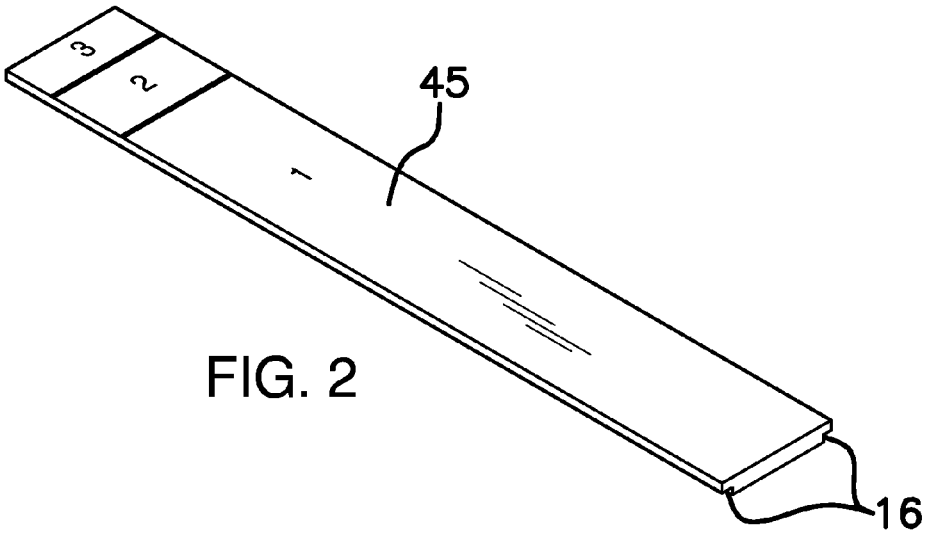
FIG. 2 is an isometric view of the shuffleboard surface, which is on the reverse side of the bowling surface with a depiction of the indentations to produce a "gutter" ball on the bowling surface.

FIG. 2 depicts the shuffleboard surface with the indentions on the opposite surface that will produce the "gutter" ball.

At one end of the bowling surface on the playing surface will be a series of holes into which a ramp 10 is inserted. A ramp adjustment 14, which consists of an opening that extends from side to side a predetermined length with oversized holes, will allow the ramp 10 to slide from side to side on the top surface to replicate when a person is bowling and thus allow the person to position the path of the ball (not depicted) when the ball is released. This ability to slide the ramp will enable the person to "aim" the ball as it is being delivered.

The ramp 10 is inserted into the ramp adjustment 14. The ball to play the game will be placed on the ramp prior to the ball being released as the person "aims" the ball and attempts to roll the ball down the ramp surface onto the bowling surface to strike the pins (not depicted) at the opposite end.

In order to make the game realistic each of the parts is sized proportionally so that the pins and ball are comparable to the sizes of a ball and pin in a normal bowling alley.

Figure 4:
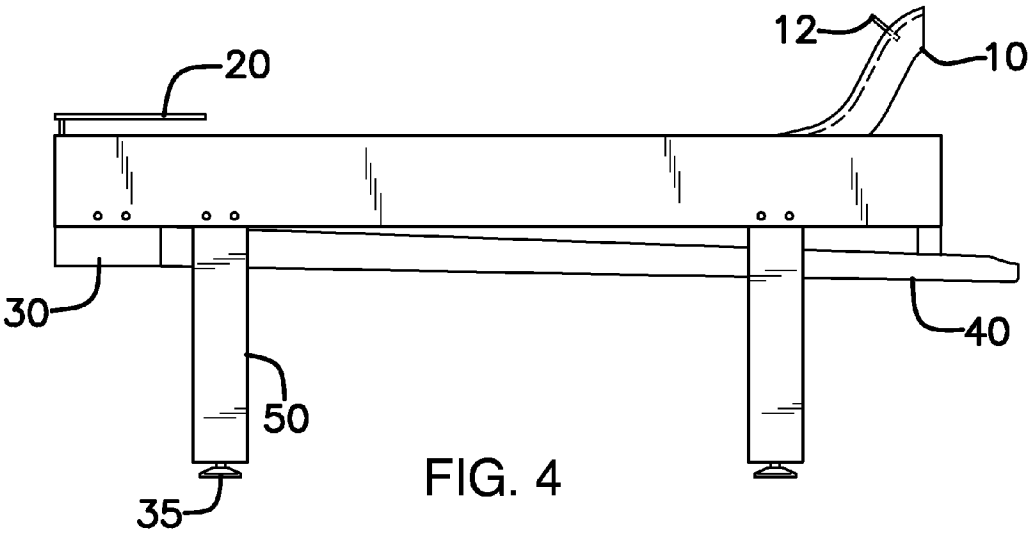
FIG. 4 is a side view of the device depicting a groove on the ramp that is shown by dotted lines.
Figure 5:
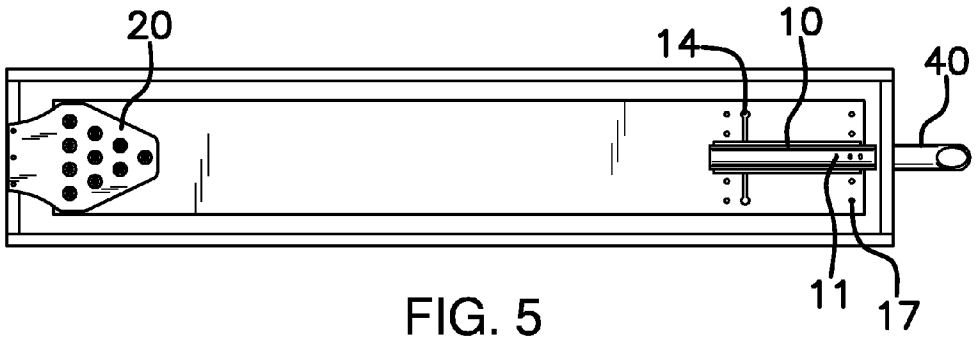
FIG. 5 is a top view of the device.
Figure 3:
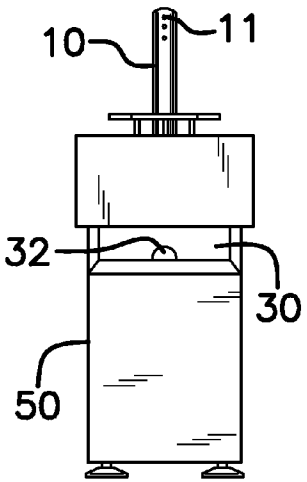
FIG. 3 is a front view of the device looking from the areas of the pins to the ramp.
Figure 6:
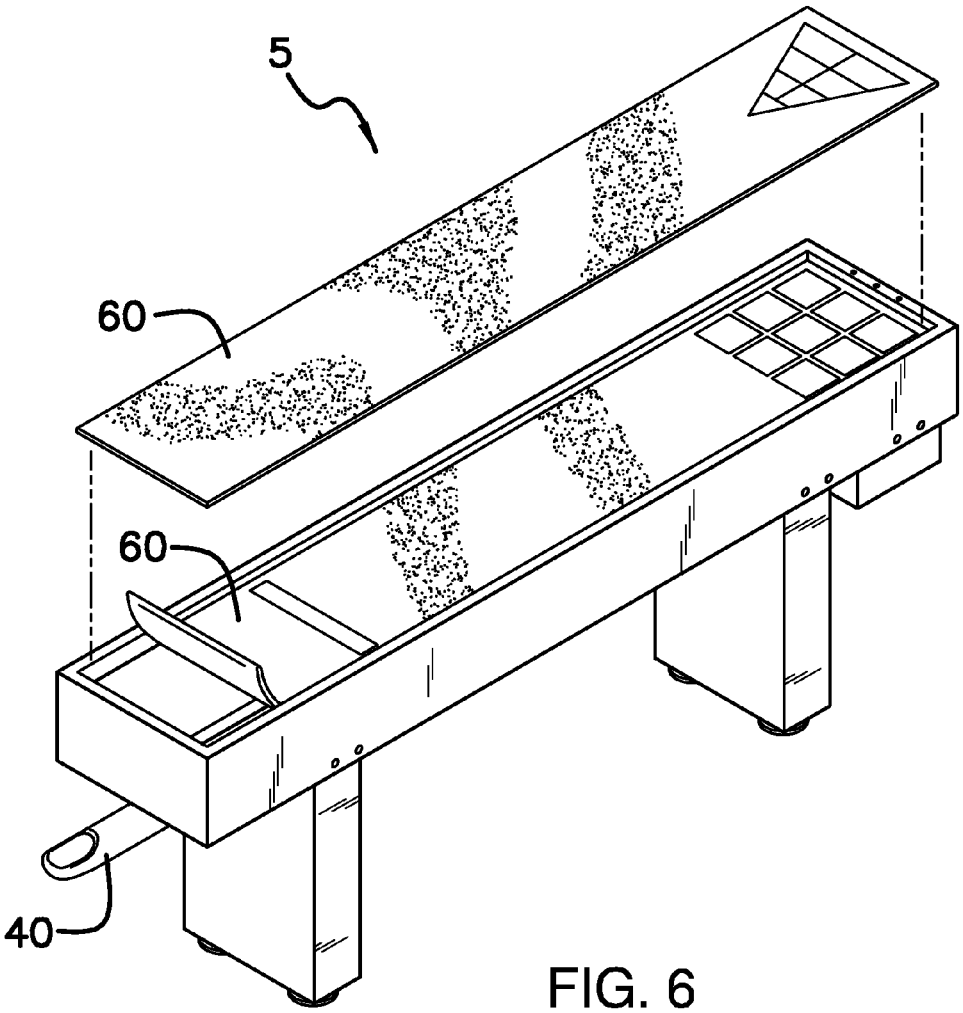
FIG. 6 is an isometric view of the device indicating that the device can be used to play other games with the use of overlays.

The individual who is playing the game will place a ball on the top portion of the ramp 10 that is slightly curved and the ball will roll down towards a set of pins, which are positioned a predetermined distance away from the ramp. A groove that is depicted in FIG. 4 as a dotted line is formed in the ramp 10 and forces the ball in a single path down the ramp toward the pins. Near the ramp, both in the front of the ramp and behind the ramp on the top surface a plurality of Braille indicators 17 are provided to assist persons who are visually impaired.

The bowling pins or target elements (not depicted) will be aligned as all bowling pins in the general shape of a triangle. There will be an auto spotter 20 which will enable the person to easily set the bowling pins in the appropriate positions. A mounting post 25 on the auto spotter 20 will enable the auto spotter to rotate when not in use.

As the ball goes down the ramp and strikes the bowling pins, the ball will then go into down pin box 30. The ball and pins are sized in proportion to each other to represent the size and weight comparison in a regular bowling game.

On one end of the down pin box there will be a ball return 40 which is a hollow tube that is slightly angled at a downward slope that will allow the ball to automatically return through an automatic ball return tube to the area of the ramp.

The individual then puts the ball again on the ramp 10 and continues to play the game. When the ramp 10 has been positioned in the ramp adjustment the ramp is allowed to swivel from side to side and move from side to side for appropriate positioning of the ball prior to releasing it on the bowling surface.

Additionally, a single handicap pin 12 will be placed in one a plurality of handicapped holes 11 on the top surface of the ramp. The placement of the handicap pin 12 eliminates some of the surface area of the ramp for the more experienced player. The shortening of the ramp surface upon which the ball will roll will reduce the speed of the ball as it rolls down the ramp 12 and therefore make it more challenging to "aim" the ball. The handicap pin forces the more experienced bowlers to play at a disadvantage relative to the novice by eliminating some of the area down which the ball can travel on the bowling surface 15.

Depending on the desires of the user the ball may be placed abutting the pin between the pin and the top surface and the player simply releases the ball to play the game or the ball may placed abutting the pin and the player must remove the pin to allow the ball to roll down the ramp 10 onto the bowling surface 15 and start the shot.

On the opposite side of the bowling surface will be a shuffleboard side 45 as depicted in FIG. 2. The shuffleboard will be played in much the same way, however using hand controls. Additionally, there will be other games 40 which can be played on the top surface by simply placing an game overlay 60 on the top surface.

The inventor claims:

1. A miniature bowling game table, comprising:

a. a playing surface;

wherein the playing surface is rectangular;

wherein the playing surface has a predetermined length and width;

wherein the playing surface is reversible;

wherein there is a first playing surface and a second playing surface;

wherein the first playing surface depicts a bowling game;

wherein the second playing surface depicts a shuffleboard game;

wherein a pair of indentations are placed on the outside edges of the playing surface;

said pair of indentations on the outside edges of the first playing surface represent a gutter when the bowling game is played;

wherein there is a first end and a second end of the playing surface;

wherein the first playing surface has a plurality of Braille indicators at the first end;

wherein a plurality of bowling pins are placed at the second end of the first playing surface;

b. a ramp;

wherein the ramp has a first end and a second end;

said first end is proximate to the playing surface;

wherein the ramp is positioned at the first end of the first playing surface;

wherein a slot is provided on the first end of the first playing surface to position the ramp;

wherein a post on the ramp is inserted into the slot;

wherein said ramp can move from side to side of the first playing surface of said first end;

wherein said ramp swivels;

wherein said ramp is slightly curved from the second end to the first end;

wherein a groove is provided on the ramp;

said groove forces the ball to move in a single path as it rolls down the ramp;

c. a plurality of handicap holes;

wherein the plurality of handicap holes are provided on the ramp;

d. a handicap pin;

said handicap pin is placed into one of the plurality of handicap holes such that the location and orientation of the hole is capable of blocking the single path of the ball;

e. a plurality of Braille indicators;

wherein the plurality of Braille indicators is positioned proximate to the first end of the ramp;

f. an auto spotter;

wherein the auto spotter is fastened to the second end of the structure on the first playing surface;

wherein the auto spotter positions the plurality of bowling pins at the second end of the first playing surface when not in use;

g. a ball;

wherein the ball is of a predetermined shape;

wherein the ball is placed on the second end of the ramp at a predetermined position on the ramp;

said position of the ball is determined by the position of the handicap pin;

said ball moves from the first end of the first playing surface towards the plurality of bowling pins positioned at the second end of the first playing surface when the ball is released;

h. a pin box;

wherein the pin box is affixed to the second end of the structure;

wherein the pin box catches the plurality of the bowling pins knocked off the first playing surface;

i. an automatic ball return;

wherein an automatic ball return is provided;

wherein said automatic ball return is positioned below the first playing surface;

j. a plurality of overlays;

wherein said plurality of overlays are placed over the second playing surface;

said plurality of overlays depict predetermined games.

2. A miniature bowling game table as described in claim 1, wherein a plurality of targets consist of pin elements whose size and weight are in substantially the same proportion to the size and weight as in a full scale bowling game.

3. A miniature bowling game table as described in claim 1, wherein the first playing surface is in substantially the same proportion as the length and width of a full scale bowling game.

4. A miniature bowling game table as described in claim 1 wherein an overlay on the second playing surface depicts a curling game.

5. A miniature bowling game table as described in claim 1 wherein an overlay on the second playing surface depicts a hockey game.

* * * * *